US005183134A

United States Patent [19]

Kuc

[11] Patent Number: 5,183,134

[45] Date of Patent: Feb. 2, 1993

[54] LUBRICATION SYSTEM FOR AIR COMPRESSOR

[75] Inventor: Victor D. Kuc, Des Plaines, Ill.

[73] Assignee: Triangle Engineered Products Co., Bensenville, Ill.

[21] Appl. No.: 820,086

[22] Filed: Jan. 13, 1992

[51] Int. Cl.[5] ..... F01M 1/00

[52] U.S. Cl. ..... 184/6.16; 184/6.5; 184/6.24; 184/97

[58] Field of Search ..... 415/110, 111, 112, 175; 210/459, 133; 184/6.12, 6.5, 6.16, 6.24, 96, 97, 31

[56] References Cited

U.S. PATENT DOCUMENTS

| | | | |
|---|---|---|---|
| 1,020,774 | 3/1912 | Nilson . | |
| 1,676,418 | 7/1928 | Vincent . | |
| 1,847,418 | 3/1932 | Steedman . | |
| 2,194,710 | 3/1940 | Metzgar . | |
| 2,328,296 | 8/1943 | Ritter . | |
| 2,614,497 | 10/1952 | Cowles . | |
| 2,827,342 | 3/1958 | Roach | 184/6.5 |
| 2,875,850 | 3/1959 | Glass et al. | 184/6.16 |
| 3,065,743 | 11/1962 | Brehm et al. . | |
| 3,976,165 | 8/1976 | Pilarczyk | 184/6.16 |
| 4,032,312 | 6/1977 | Anderson | 415/112 |
| 4,446,377 | 5/1984 | Kure-Jensen et al. | 415/175 |
| 4,586,875 | 5/1986 | Aman, Jr. . | |

*Primary Examiner*—James C. Yeung
*Assistant Examiner*—Alan B. Cariaso
*Attorney, Agent, or Firm*—Leydig, Voit & Mayer

[57] ABSTRACT

In a lubricant delivery system for use in an air compressor having a rotatable crankshaft and an internal chamber accessible by removal of an inspection plate having inner and outer surfaces, a positive displacement fluid pump mounted in the internal chamber and fluid lines for conveying lubricating fluid from the pump to a removable filter mounted on the outer surface of the inspection plate. Pressure relief means are associated with the filter for relieving pressure above a set point, and a distribution ring is adaped to circumscribe the crankshaft for introducing lubricating fluid to the crankshaft and from there to areas where lubrication is required.

7 Claims, 3 Drawing Sheets

LUBRICATION SYSTEM FOR AIR COMPRESSOR

FIELD OF THE INVENTION

The present invention relates generally to lubrication systems, and more particularly to a new and useful arrangement of components for an air compressor lubrication system. As illustrated and described below, the system has particular utility in a Westinghouse "3-CD" series two stage air compressor or similar unit.

BACKGROUND OF THE INVENTION

The lubrication system utilized in most air compressors, including the Westinghouse "3-CD" series two stage air compressor, has remained virtually unchanged since the 1940's. Ensuring adequate lubrication, however, has been a continuing design problem.

The lubrication system presently utilized in many compressors draws oil or other lubricating fluid from a sump located within the crankcase, in the same manner that water is "drawn" from a farmer's hand well pump. This lubrication system typically comprises a cartridge having inlet and discharge check valves, a hollow pump plunger having one end driven off an eccentric on the crankshaft to provide both an oscillating and reciprocating motion, and a pump body to house the plunger and cartridge. In operation, rotation of the crankshaft causes the plunger to reciprocate in the pump body, thereby drawing lubricating fluid from an underlying sump through the cartridge inlet and discharge check valves and into the plunger's hollow interior. From the interior of the plunger, lubricating fluid is directed through passageways associated with the crankshaft to wear areas by means of positive pressure.

It has been found that the single reciprocating pumping action of present lubrication systems results in undesirable pressure pulses. Moreover, such systems have been found to provide a relatively low output volume and pressure. To overcome these deficiencies, the present invention employs a positive displacement rotary pump capable of delivering a continuous flow of lubricating fluid, thereby providing a significantly higher overall system pressure and volume.

Conventional lubricating systems also provide only minimal filtration of the lubricating fluid through use of a coarse screen, typically placed in front of the pump inlet. The present invention recognizes the need for increased filtration of the lubricating fluid to minimize wear of the pump and compressor and thus calls for a replaceable filter module which is mountably attached to a removable inspection plate on the exterior of the compressor. This combination of an externally mounted filter module and removable inspection plate provides for the removal of particulate matter which can greatly reduce the useful life of bearings and other moving components, while at the same time providing a viewing port for inspection and maintenance.

OBJECTS AND SUMMARY OF THE INVENTION

The primary object of the present invention is to provide an improved lubrication system for air compressors such as the Westinghouse "3-CD" series and similar units. It is a related object to provide a lubrication system which produces a pressure which is both higher and more constant than that obtained by the plunger-driven reciprocating pumps presently employed. These objects are realized through use of a positive displacement gear-driven pump in series with a readily replaceable filtration medium. As will be described in greater detail hereinafter, lubricating fluid flows from the replaceable filter to an opening in the crankshaft, thereby allowing flow through internal passages within the crankshaft to areas requiring lubrication.

Unlike a reciprocating pump, which delivers lubricating fluid in a pulsating fashion, giving rise to fluctuations in system pressure, the positive displacement pump utilized herein provides a continuous and steady flow of lubricating fluid to the crankshaft. The lubrication system of the present invention thus ensures that the flow of lubricating fluid to areas requiring lubrication—especially those areas at a substantial distance from the crankshaft inlet port—will not be subject to sporadic interruption. Such sporadic lubrication can, of course, lead to the premature wear of moving parts, thereby necessitating costly and time-consuming repairs.

Another object of the present invention is to provide improved filtration of the lubricating fluid while at the same time facilitating maintenance and inspection of the filter medium and the lubrication system. To this end, the present invention employs a replaceable filter cartridge which is mounted on a removable plate on the exterior of the compressor. Removal of the plate permits inspection of the filter feed lines, the pump, and the pump's associated drive mechanism.

These and other objects and advantages of the present invention will become apparent from the following detailed description when taken in conjunction with the accompanying drawings.

While the present invention will be described and disclosed in connection with certain preferred embodiments, it is not intended to limit the invention to those specific embodiments. Rather, it is the applicant's intention to cover all such alternative embodiments and modifications as fall within the spirit and scope of the appended claims.

DETAILED DESCRIPTION OF THE PREFERRED EMBODIMENT

Figure 1:
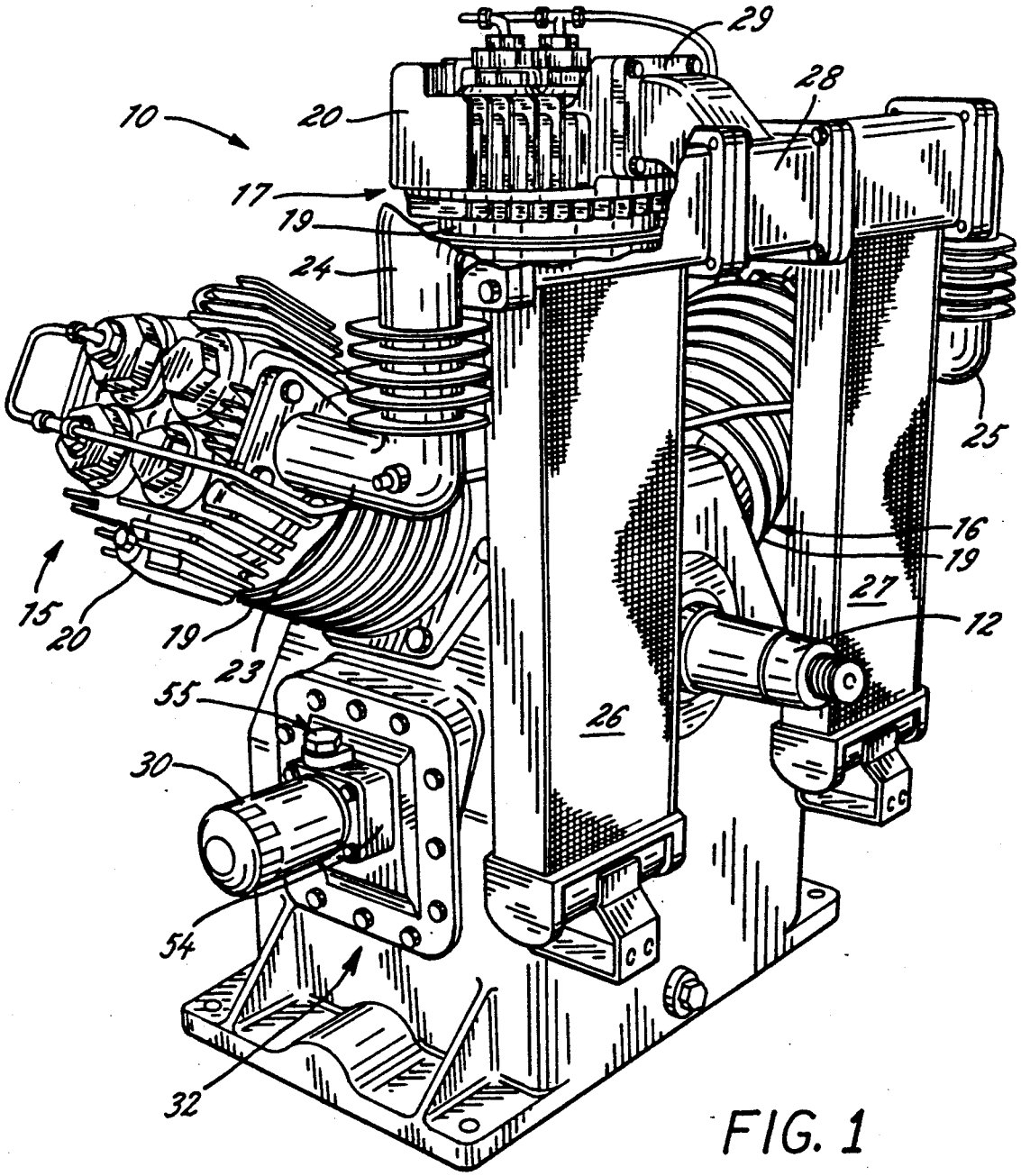
FIG. 1 is an exterior view of an air compressor which utilizes the lubrication system of the present invention.

Referring now to the drawings, an air compressor 10 is shown generally in FIG. 1. Although those skilled in this art will recognize the compressor as a Westinghouse type "3-CD" series, the invention is not intended to be limited solely to such compressors but may be used in other compressors, and machinery having rotatable drive members. Nevertheless, a brief description of the configuration and operation of a Westinghouse "3-CD" series compressor is useful to an understanding of the preferred embodiment of the present invention.

The Westinghouse "3-CD" air compressor is a two stage compressive unit. The compressor is operated by means of a central crankshaft 12 journaled in a crankcase having an internal chamber. The central crankshaft may be rotated by any appropriate power source (not shown), including an electric or diesel engine. Rotation of the crankshaft 12 causes pistons to move in a reciprocating manner in compression cylinders 15, 16 and 17. Each cylinder includes a body portion 19 and a head portion 20. Gasket means are interposed between the body portion 19 and the main compressor structure, and at the interface between the body portion 19 and the cylinder head 20.

When the compressor 10 is in operation, air is drawn from ambient through a filter unit (not shown) during the downstroke of the piston, through an inlet port (not shown) on the cylinder head 20 of cylinders 15 and 16. During the upstroke of the piston the air in the cylinder is compressed to approximately 40 psig and is expelled through outlet port 23. The compressed air then passes through a right hand riser 24 and left hand riser 25 connected to compression cylinders 15 and 16, respectively. The compressed air, which has increased in temperature due to the initial compression in cylinders 15 and 16, is then passed through intercooler core sections 26, 27. There the temperature of the compressed air is reduced by conventional conductive and convective heat transfer techniques. The cooled, compressed air is thereafter delivered from the separate intercooler core sections 26, 27 to a central manifold 28. The combined flow of compressed air is then passed into inlet port 29 of compression cylinder 17. The air is then further compressed through movement of the piston within cylinder 17 in the same manner as previously described in relation to cylinders 15 and 16. Following this second stage of compression, the air is expelled through an exhaust port (not visible) in the cylinder head of compression cylinder 17 at a pressure of approximately 140 psig. The compressed air is thereafter conveyed to storage tanks for later use.

Keeping in mind the compressor operation described above, the lubrication system of the present invention is operatively connected to the crankshaft 12 to continuously pump lubricating fluid through an externally mounted filter cartridge 30 to wear areas within the compressor. The replaceable filter cartridge 30 is externally mounted on a crankcase inspection plate 32, which is readily removable to afford access to the internal crankcase chamber and pumping mechanism shown most clearly in FIG. 3.

The filter cartridge 30 may be comprised of an internal filter element (not shown) and an external filter case 34, having a removable cap 36. Alternatively, the filter cartridge can be unitary, so that the filter media and filter case can be replaced as a unit. The filter element may be formed from any appropriate filter media capable of providing efficient particulate removal while remaining chemically nonreactive with respect to the lubricating fluid being processed. The external filter case may be formed from any material suitable to house and protect the filter media. In addition, the filter cap will preferably include external ridges which provide a gripping surface to facilitate removal and replacement of the cap when the filter element is replaced or cleaned, or removal of the filter case when the cap and case are a unitary construction.

Figure 3:
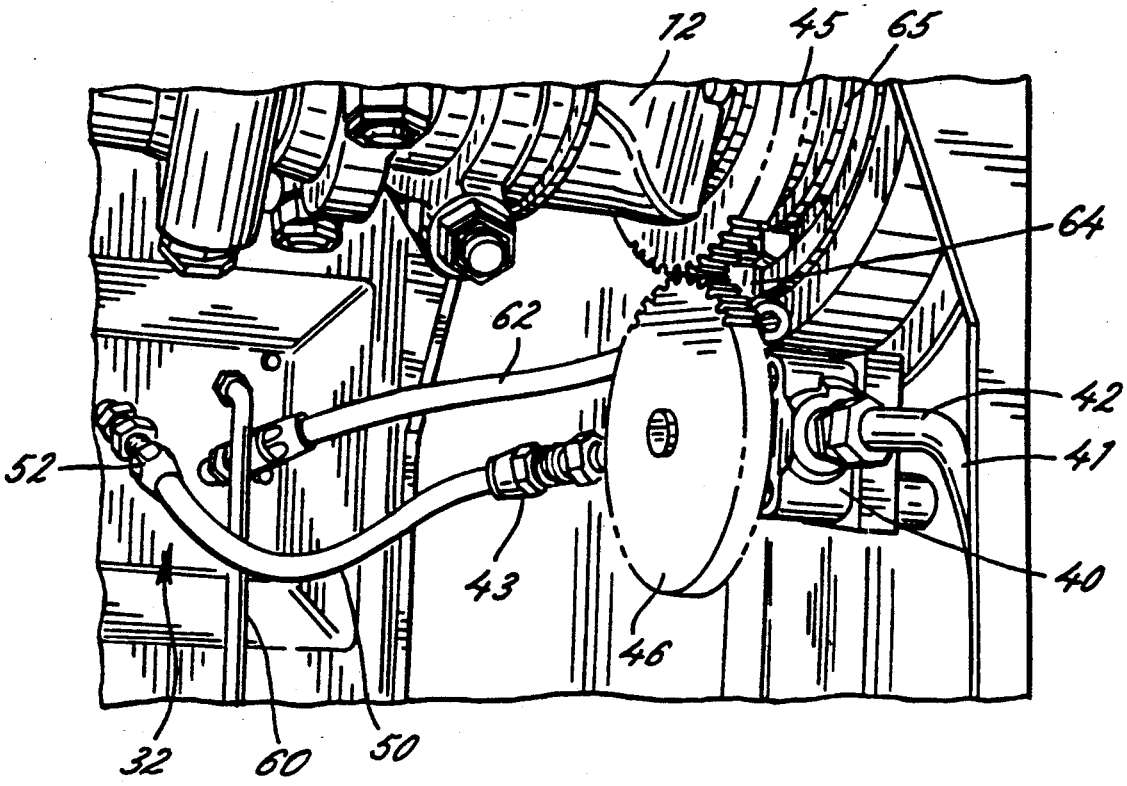
FIG. 3 is a perspective view of the positive displacement pump of the present invention located within an internal crankcase chamber and the backside of the inspection plate.
Figure 4:
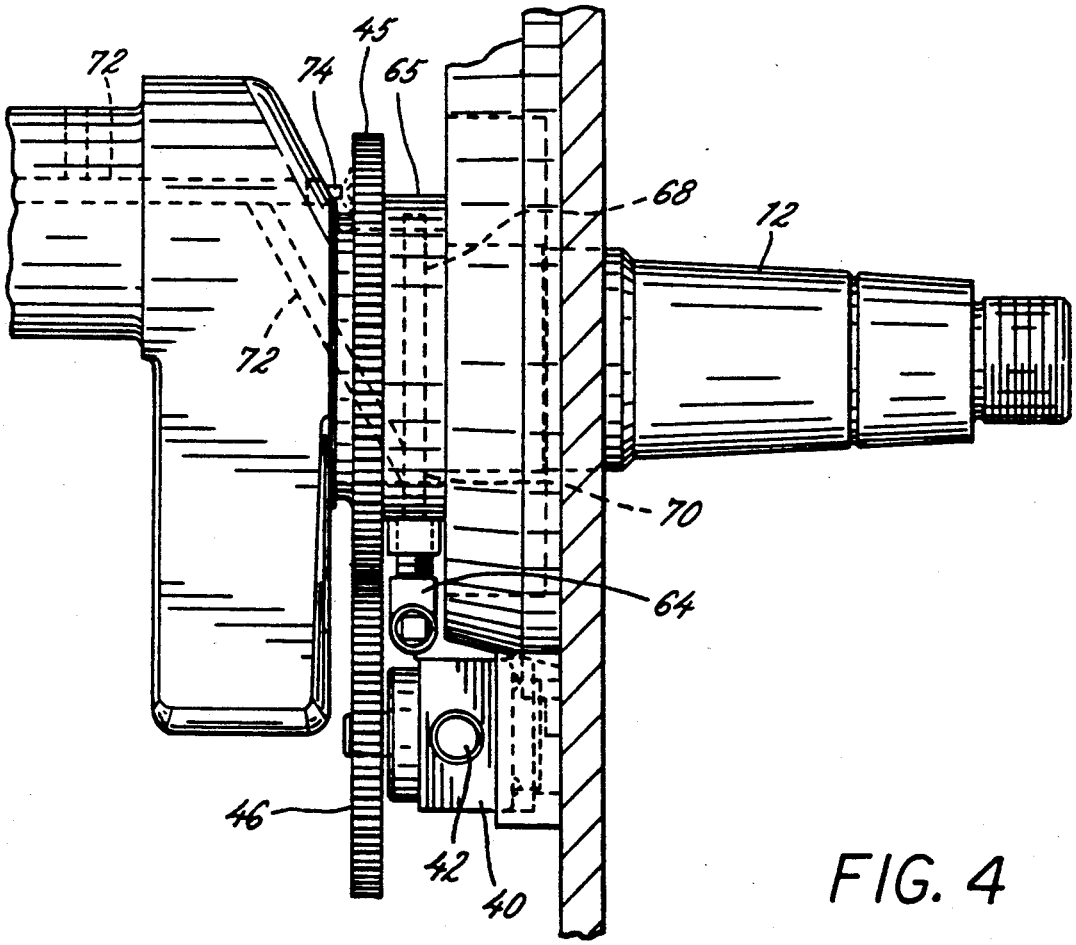
FIG. 4 is a side view of the compressor crankshaft depicting the arrangement of the pumping and distribution components of the lubrication system of the present invention.

The rotary pump 40 and associated elements are most clearly seen in FIG. 3. In the preferred embodiment, lubricating fluid is drawn by a rotary pump 40, such as a Tuthill Model #1RFD-1 or the like, from a sump (not shown) located in the lower portion of the compressor structure. The lubricating fluid is carried from the sump to the pump via first delivery means such as transfer line 41. The lubricating fluid is drawn into pump 40 through inlet 42 at a relatively low pressure and is discharged through outlet 43 at a significantly higher pressure. The pump 40 is operatively coupled to the crankshaft by power transfer means which in the preferred embodiment include a drive gear 45 and pump drive gear 46, and as shown in FIG. 4 is mounted on a sidewall of the compressor structure. The crankshaft drive gear 45 is mounted on and is rotated via revolution of crankshaft 12. Pump drive gear 46 is mounted on rotary pump 40 and intermeshes with crankshaft drive gear 45 so as to facilitate steady power transfer to the rotary pump 40.

The ratios of the intermeshing crankshaft drive gear 45 and pump drive gear 46 will be selected to impart the drive speed to rotary pump 40 which is necessary to operate within the desired range of pressure and volumetric flow. This optimum operational drive speed is dependent upon the specific rotary pump 40 which is selected and will, in normal instances, be readily determined from characteristic data curves supplied by the pump manufacturer.

An important aspect of the preferred embodiment of the present invention is the use of a rotary pump 40 which may be operated by rotation of the pump drive gear 46 in either a clockwise or counter-clockwise direction. The use of a rotary pump with this capability allows the rotary pump to be driven from either end of crankshaft 12, thereby affording the user a greater degree of freedom in orienting the components of the lubrication system with respect to the main compressor housing and crankshaft.

Figure 2:
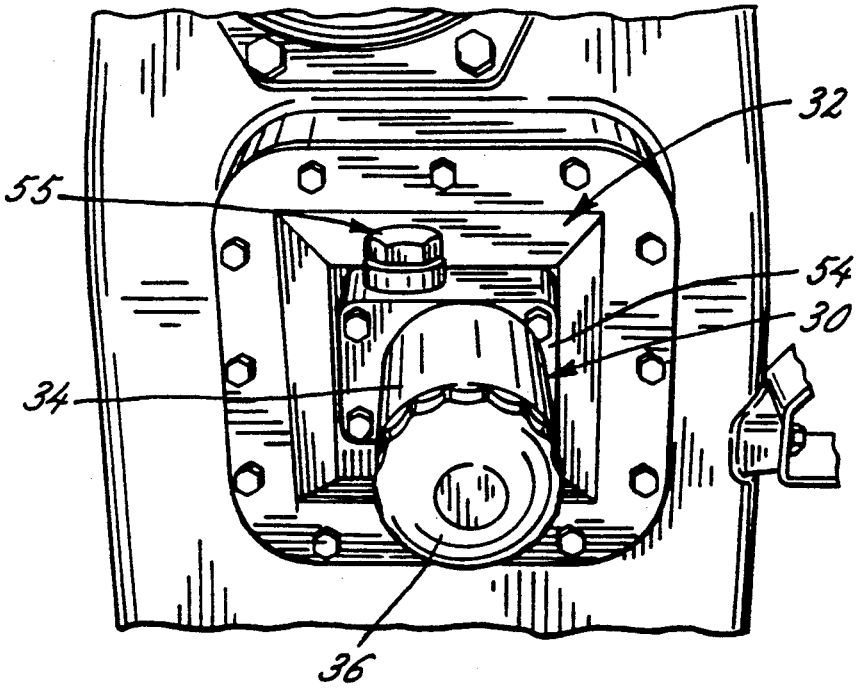
FIG. 2 is a detail of the filter unit of the lubrication system and shows the filter cartridge mounted on a removable exterior inspection plate.

Upon discharge from rotary pump 40, the lubricating fluid is conveyed by positive pressure through a second delivery means such as flexible transfer line 50 to the filter inlet 52. After passing through the filter element, the lubricating fluid passes through a relief valve housing 54 as most clearly seen in FIGS. 1 and 2. The relief valve contained within this housing is adjustable by means of a set bolt 55 to permit the increase or decrease of the system operating pressure and is of conventional design. As contemplated, the relief valve serves to protect the filter module and other components of the system from fluid pressure in excess of safe operational limits. Fluid above the set pressure of the relief valve is bypassed through the inspection plate through delivery means such as conduit 60 to the crankcase sump.

Figure 5:
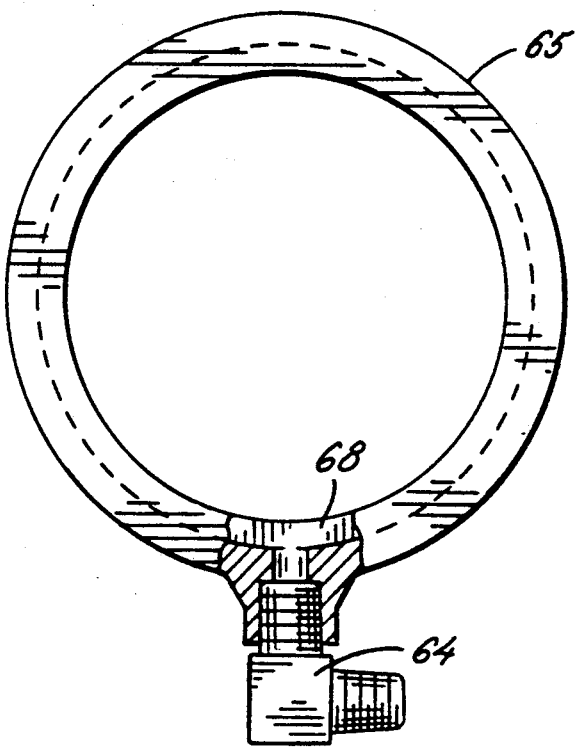
FIG. 5 is an elevational view of the lubricating fluid distribution ring which is shown in side view in FIG. 4.

Lubricating fluid below the set pressure of the relief valve flows through third delivery means such as flexible transfer line 62 to an inlet 64 on distribution ring 65, as shown in FIGS. 4 and 5. Distribution ring 65 is mounted on and circumscribes compressor crankshaft 12, and as shown in the isolated elevational view in FIG. 5, is provided with an internal annular groove 68 through which lubricating fluid is introduced into the crankshaft for distribution to areas where lubrication is required. An opening 70 in the form of a port on the surface of the crankshaft communicates with groove 68, as best seen in FIG. 4, and effects the continuous delivery of lubricating fluids from the annular groove 68 into port 70 during rotation of crankshaft 12. The lubricating fluid is thereafter transferred by means of positive pressure through fourth delivery means such as passages 72 located within the crankshaft to wear areas where lubrication is required. The lubricating fluid is also transferred through internal passageways to spray nozzle 74, which serves to provide lubricating fluid to the teeth of crankshaft drive gear 45.

The spray nozzle 74 is of a plug design which is well known in the art. The plug is comprised of an externally threaded flange at one end and an angled drilled orifice at the other. A bore runs axially through the nozzle. In operation, the threaded portion of the nozzle is inserted into a threaded female socket in the crankshaft thereby connecting the bore of the spray nozzle 74 and internal fluid passageway 72. The nozzle is preferably rotatably adjustable to provide a continuous spray of lubricating fluid to crankshaft gear 45 as may be seen in FIG. 4. After introduction of the lubricating fluid to the bearing areas of the teeth on gears 45 and 46, the fluid is returned to the crankcase sump (not shown) by gravitational forces.

Those skilled in the art will appreciate that the lubrication system of the present invention can be installed as original equipment on air compressors, or can be retrofit to upgrade the lubrication systems of older compressors. In these latter applications, removal of a portion of a sidewall of the compressor structure, if necessary, not only facilitates installation of the lubrication system, but also creates a port which can then be covered by the inspection plate. Subsequent removal of the inspection plate thus permits easy monitoring and periodic maintenance of the internal components of the compressor and the lubrication system.

I claim as my invention:

1. A lubricant delivery system for use in an air compressor having an internal crankcase chamber accessible by removal of an inspection plate having inner and outer surfaces, the compressor having a rotatable crankshaft journaled in the crankcase and a sump in the crankcase for lubricating fluid, the delivery system comprising in combination, a positive displacement fluid pump having inlet and outlet ports mounted in said internal crankcase chamber, said pump being driven through power transfer means operatively coupled to said crankshaft, first delivery means for conveying fluid between the sump and said pump inlet port, removable filter means for filtering the lubricating fluid and having an inlet and an outlet, said filter means being disposed exteriorly of the crankcase chamber and carried on the inspection plate, and second delivery means for conveying lubricant between said pump outlet port and said filter means inlet;

pressure relief means for relieving pressure above a set point, said pressure relief means having fluid entrance, exit and bypass openings adapted for fluid flow therethrough, said pressure relief means being interposed between the removable filter means and the outer surface of the inspection plate, a distribution ring adapted to circumscribe said crankshaft and having an internal annular groove for introducing lubricating fluid to said crankshaft, and third delivery means for conveying lubricant from the exit of said pressure relief means to said annular groove, said pressure relief means fluidically interconnecting the outlet of said filter means and said third delivery means, fourth delivery means associated with said crankshaft for conveying lubricating fluid from said annular groove to wear areas where lubrication is required, and fifth delivery means for conveying lubricant from said pressure relief means bypass opening through said inspection plate and back to said sump.

2. An air compressor lubrication system according to claim 1 wherein said power transfer means between said positive displacement fluid pump and said rotatable crankshaft include intermeshing gears, one of said gears being mounted on said crankshaft for rotation therewith.

3. An air compressor lubrication system according to claim 1 wherein said positive displacement fluid pump is reversible and operable by means of rotation of said crankshaft in either a clockwise or counter-clockwise direction.

4. An air compressor lubricating system according to claim 1 wherein selective ones of said first through fifth lubricant delivery means include flexible tubing.

5. An air compressor lubricating system according to claim 2 wherein said fifth delivery means for conveying lubricating fluid from the annular groove to wear areas includes a nozzle for directing lubricating fluid to said intermeshing gears.

6. An air compressor lubricating system according to claim 1 wherein said pressure relief means has means for adjusting the set point to permit adjustment of the operating pressure of the system.

7. An air compressor lubricating system according to claim 1, wherein said filter means and said pressure relief means are integrally connected and mounted on said outer surface of said inspection plate.

* * * * *